ELECTRIC INCANDESCENT LAMP

The invention relates to an electric incandescent lamp, in particular a halogen incandescent lamp, comprising a tubular envelope which is closed at both ends by a pinch seal and in which a coiled-coil filament is stretched which extends coaxially in the envelope and which is supported in at least one place between the pinch seals by a support which is formed from a metal wire, of which support a first helically wound part supports the filament and of which a second part bears on the inner wall of the envelope. Such an incandescent lamp is known inter alia from the German Gebrauchsmuster No. 1955504.

In the electric incandescent lamp according to said Gebrauchsmuster the said first part of the support formed form metal wire consists of a single helical wire turn which is arranged around the secondary winding of the filament. The winding sense of said wire turn is opposite to that of the secondary winding of the filament. Said wire turn should be arranged around the secondary winding of the filament so solidly that the support cannot move axially in the envelope. It has been found, however, that the arrangement of the support can easily result in damaging of the filament.

It is the object of the invention to provide an electric incandescent lamp of the above mentioned type which does not exhibit the said drawback.

For that purpose, the electric incandescent lamp according to the invention is characterized in that the first part comprises at least two turns the winding sense of which corresponds to that of the secondary winding of the filament and which part is present inside the secondary winding of the filament. Since the winding sense of said first part of the support corresponds to that of the secondary winding of the filament, the support can be secured to the filament in that the said part of the support is screwed into the secondary winding of the filament which can be done without exerting force on the filament. In said screwing movement a part of the support which connects the first part to the second part, is moved between the turns of the secondary winding of the filament. Said part prevents the support from moving axially in the envelope. Since the said first part has at least two turns, its length is sufficient to support at least one secondary turn of the filament.

The invention will now be described in greater detail with reference to the accompanying drawing, in which:

FIG. 1 shows an electric incandescent lamp according to the invention,

FIG. 2 is a detail II on an enlarged scale of FIG. 1.

The electric incandescent lamp shown in FIG. 1 comprises a tubular envelope 1 which is sealed at the ends by pinch seals 2 and 3. Lead-throughs 4, foils 5 and lead-outs 6 are sealed in said pinch seals in the usual manner. A coiled-coil filament 7 is stretched coaxially in the envelope and is supported in this embodiment in two places between the ends. For that purpose, supports 8 are present which are formed from wire material. Said supports comprise a first part 9 which has a helically wound shape and supports the filament (see also FIG. 2). The first part 9 in this embodiment comprises three turns and is present within the secondary winding of the filament. The support 8 furthermore comprises a second part 10 which bears on the inner wall of the envelope 1 so that the filament constantly assumes a coaxial position in the envelope. The part of the support denoted by 11 is present between two adjacent turns of the secondary winding of the filament and prevents the support from moving axially in the envelope. As is shown in FIG. 2, the winding sense of the helically wound first part of the support corresponds to that of the secondary winding of the filament.

What is claimed is:

1. An electric incandescent lamp, in particular a halogen incandescent lamp, comprising a tubular envelope which is closed at both ends by a pinch seal and in which a coiled-coil filament is stretched which extends coaxially in the envelope and which is supported in at least one place between the pinch seals by a support which is formed from a metal wire, of which support a first helically wound part supports the filament and a second part bears on the inner wall of the envelope, characterized in that the first part comprises at least two turns, the winding sense of which corresponds to that of the secondary winding of the filament and which part is present inside the secondary winding of the filament.

* * * * *

United States Patent [19]

Hofstein

[11] 3,940,651

[45] Feb. 24, 1976

[54] TARGET STRUCTURE FOR ELECTRONIC STORAGE TUBES OF THE COPLANAR GRID TYPE HAVING A GRID STRUCTURE OF AT LEAST ONE PEDESTAL MOUNTED LAYER

[75] Inventor: Steven R. Hofstein, Princeton, N.J.

[73] Assignee: Princeton Electronics Products, Inc., North Brunswick, N.J.

[22] Filed: Mar. 8, 1974

[21] Appl. No.: 448,613

[52] U.S. Cl. ..... 313/391; 313/392

[51] Int. Cl.[2] ..... H01J 31/08; H01J 29/41

[58] Field of Search ..... 313/392, 391, 367, 366

[56] References Cited

UNITED STATES PATENTS

| | | | |
|---|---|---|---|
| 3,523,208 | 8/1970 | Bodmer et al. | 313/367 X |
| 3,576,392 | 4/1971 | Hofstein | 313/367 X |
| 3,631,294 | 12/1971 | Hofstein | 313/392 X |
| 3,737,715 | 6/1973 | Silver | 313/391 X |
| 3,805,126 | 4/1974 | Frobenius | 313/392 |

FOREIGN PATENTS OR APPLICATIONS

| | | | |
|---|---|---|---|
| 2,019,842 | 11/1971 | Germany | 313/392 |

*Primary Examiner*—Robert Segal

*Attorney, Agent, or Firm*—Ostrolenk, Faber, Gerb & Soffen

[57] ABSTRACT

A target structure for electronic storage tubes which is of the "coplanar grid" type. The target comprises a conducting layer which in a preferred configuration has slender elongated pedestals supporting elongated spaced parallel insulating strips which serve as the coplanar grid. The spaces between adjacent edges of insulating strips expose regions of the conducting layer to enable an electron beam to contact the exposed regions of the conducting layer. The pedestals support the insulating strips a spaced distance above the exposed regions of the conducting layer to form "vacuum gaps" which serve to inhibit electrical charge on the surfaces of the insulating strips from transferring to the interface between each strip and the vacuum gap. The pedestals may be an integral part of the conducting layer or may be formed from an insulating material. Methods for producing the novel target are described.

8 Claims, 11 Drawing Figures

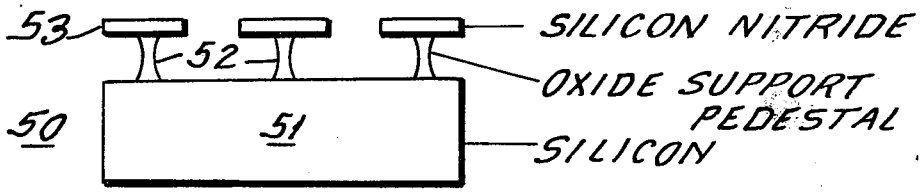

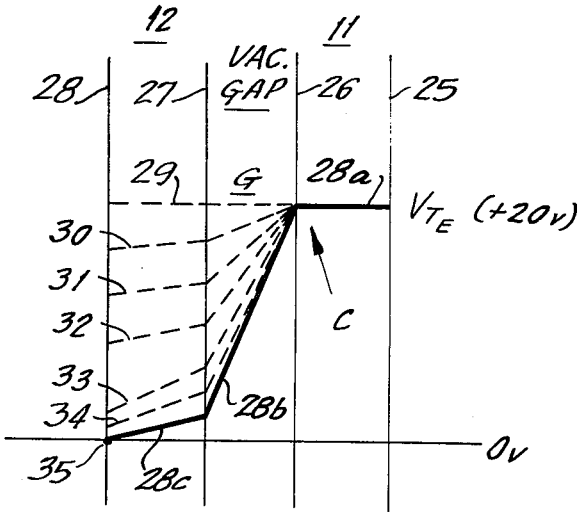
FIG. 2a.
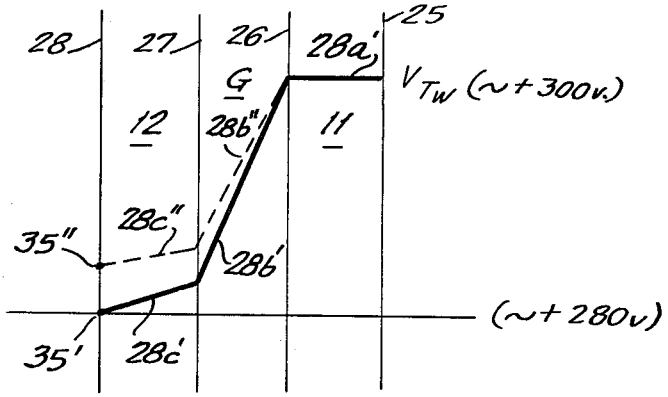
FIG. 2b.
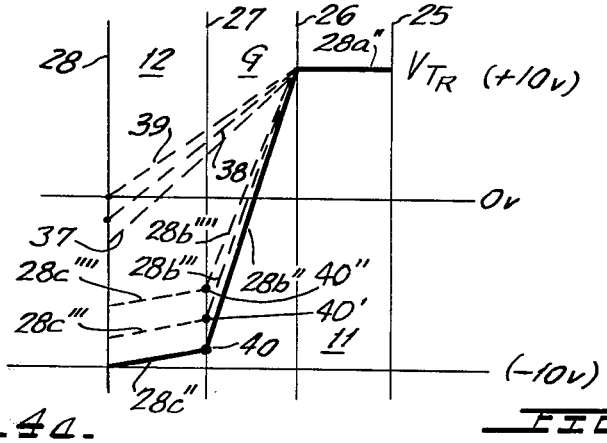
FIG. 2c.
FIG. 4a.
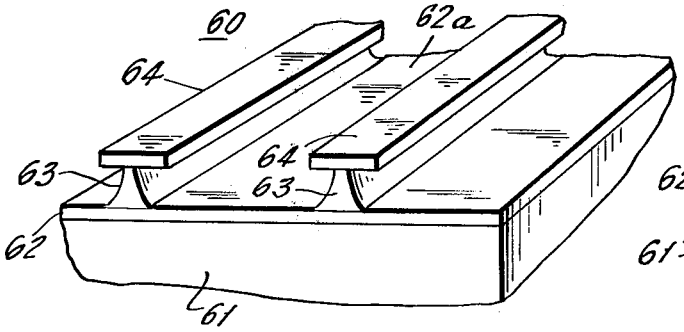
FIG. 4b.
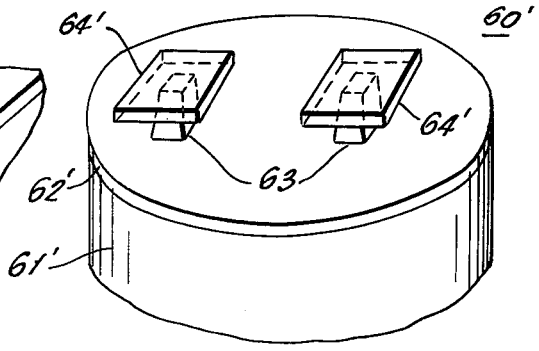

TARGET STRUCTURE FOR ELECTRONIC STORAGE TUBES OF THE COPLANAR GRID TYPE HAVING A GRID STRUCTURE OF AT LEAST ONE PEDESTAL MOUNTED LAYER

The present invention relates to electronic storage tubes utilizing beam current reading (for example, see "Electronic Image Storage" by Kazan and Knell, Academic Press 1968, pp. 123–129), and more particularly to target structures of the coplanar grid type for use in such electronic storage tubes in which the grid structure is pedestal mounted and further relates to a method of producing same.

BACKGROUND OF THE INVENTION

Electronic storage tubes having target structures of the coplanar grid type are presently in use and are extremely advantageous for use in a wide variety of applications in which it is desired to generate an image of data, pictures and other like material, store the image for substantially long periods of time and repeatedly read out the image, for example, for display purposes in cathode ray tube display devices, wherein repeated read out and display operations do not impair the stored image.

Electronic storage tubes of the type described hereinabove typically employ target structures comprising a layer of conductive material such as conducting silicon and a coplanar grid structure affixed thereto and which, in turn, is usually comprised of a striped pattern of elongated strips of a suitable insulation material such as, for example, a silicon dioxide layer which is arranged in such a fashion upon the conducting silicon as to produce a striped pattern, wherein every pair of adjacent insulation strips are separated by an exposed surface area of conducting silicon.

The insulating grid structure serves as a storage means for storing an electrical charge pattern to develop a surface potential upon the target which pattern represents a stored image.

The storage pattern is developed by scanning the target with an electron beam which sweeps across the target. Simultaneously therewith, the electronic storage tube electron gun control grid has a modulating voltage applied thereto which represents the image or data to be stored and which is employed to modulate the electron beam as it sweeps the target.

Prior to the writing mode, the target is erased, that is conditioned preparatory to image storage by sweeping the target with an unmodulated electron beam (of substantially constant current density) to create a uniform negative charge pattern on the insulator surface which results in an insulator surface potential which may typically be of the order of ten to twenty volts lower than the target voltage applied to the target. During the write mode the target voltage is typically of the order of 200 to 300 volts. The insulator surface potential, although 10 to 20 volts lower than the target voltage, is still nevertheless at a high voltage level causing the electron beam to strike the target member at a velocity which causes the electrons on the grid surface to be "knocked off" in quantities greater than those electrons which land and are retained upon the surface. This "secondary emission" effect drives the surface potential more positive with the degree of increase in the positive direction being a function of the intensity of the electron beam and its "dwell time" at each point. This operation creates and stores an image having an insulator surface charge pattern and hence a surface potential which is a function of the stored image.

Read-out of the stored image may be performed by first reducing the target voltage to a value such that all points of the insulator surface return to negative values (typical read target voltage values are 5 to 10 volts), and scanning the target with an unmodulated electron beam. The coplanar grid functions in much the same manner as the control grid of a vacuum tube triode which reduces electron current flow to the anode as the control grid is driven more negative relative to the cathode and which increases the electron flow to the anode as the control grid goes more positive relative to the cathode. In a like manner, those locations on the coplanar grid surface which are at or slightly below cathode potential during the read operation permit maximum target current, while those points of the surface potential pattern which are increasingly more negative than the cathode potential conversely reduce target current until the point is reached where the negative surface potential is sufficient to prevent any electrons from striking the exposed conducting silicon in those regions which are immediately adjacent the most negative surface potential locations. Typically, for a target construction where the exposed conducting silicon area is approximately equal to the insulator surface area, this current cut-off occurs for an insulator surface potential ($\phi_i$) equal and opposite to the target voltage ($V_T$) (that is $I_{TARGET}=0$ when $\phi_i \approx -V_T$). Typical values are $V_T=+10$ volts for which $\phi_i=-10$ volts will stop all current flow. Preferably, after writing, all points of the coplanar grid surface are maintained below the cathode potential to prevent electrons from the electron beam from striking the grid surface, causing no impairment of the stored image so that the stored image can be repeatedly read out many times without suffering degradation in the resolution and quality of the image.

Careful observation of the electronic storage tubes of the types described hereinabove has shown that image fading does in fact occur. Experimentation undertaken by this inventor has shown that in addition to the well known fading mechanism of gas ion discharge of the insulator surface charge, other effects, such as ionizing radiation induced conductivity in the insulating grid play a significant role.

BRIEF DESCRIPTION OF THE INVENTION

The present invention is characterized by providing a novel target structure for electronic storage tubes which remarkably improves retention time, as well as greatly increasing the speed of erasure and has high resolution. The present invention also teaches methods for producing the novel target.

In one preferred embodiment of the present invention the storage tube target structure comprises a conducting member which may, for example, be conducting silicon, having a plurality of elongated members composed of insulating material resistant to the effects of ionizing radiation and preferably in the form of strips arranged in substantially spaced parallel fashion so as to form a striped pattern upon the conducting silicon. Each of the insulating strips are mounted upon slender elongated pedestals which form an integral part of the conducting silicon. The coplanar grid structure is arranged so that the adjacent edges of the insulating strips are spaced from one another to expose interspersed surfaces of the bare conducting silicon.

In another preferred embodiment the pedestals are formed of an insulation material different from the strips which they support. The strips, in either preferred embodiment, may be formed of low or high capacitance materials such as, for example, aluminum oxide, silicon nitride, silicon oxynitride or silicon dioxide. The insulation material utilized for the pedestals may be selected from the same group of materials. In addition, at least one of the two insulation materials used should be resistant to the effects of ionizing radiation. For example, the strips may be formed of silicon nitride (which is radiation resistant) and the pedestal of silicon dioxide (which is not radiation resistant). Alternatively the strips may be formed of silicon dioxide and the pedestal of silicon nitride. Detailed methods for producing these embodiments are set forth below.

It is therefore one object of the present invention to provide a novel target structure for electron storage tubes having the advantageous characteristics of significantly improved retention time, reduced erasure time and high resolution.

Another object of the present invention is to provide target structures for electronic storage tubes having a coplanar grid structure mounted upon slender pedestals for enhancing retention time and reducing erasure time while providing a tube having high resolution.

Another object of the present invention is to provide novel methods for fabricating electron storage tube target structures so as to provide a coplanar grid structure mounted upon the target structure conducting member by means of slender pedestals.

BRIEF DESCRIPTION OF THE FIGURES

The above as well as other objects of the present invention will become apparent when reading the accompanying description and drawings in which.

FIGS. *2a–2c* show a curve useful in describing the operational modes of the target structure of FIG. *2a* and the unique features derived therefrom;

FIGS. *3a–3d* show target structures in various stages of fabrication which are advantageous for explaining the novel methods employed in producing target structures embodying the principals of the present invention; and FIGS. *4a* and *4b* are perspective views showing other alternative embodiments of the invention.

DETAILED DESCRIPTION OF THE FIGURES

Figure 1:
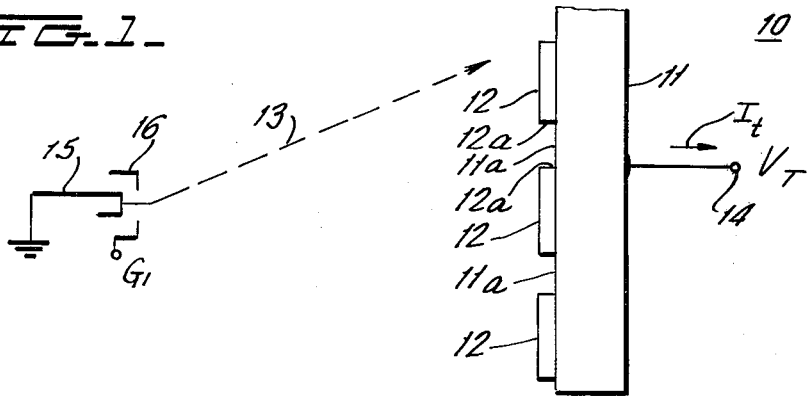
FIG. 1 shows a simplified diagram of a coplanar grid type target structure and associated components of an electronic storage tube sufficient for explaining the operation thereof.

FIG. 1 shows a target structure 10 of the coplanar grid type which, in one preferred embodiment, comprises a conducting silicon member 11 having a coplanar grid structure comprised of a plurality of thin elongated strips 12 arranged so that the adjacent edges 12*a* of strips 12 expose interspersed surface areas 11*a* of the conducting silicon. The strips 12 are typically formed of a suitable insulation material such as, for example, silicon dioxide. The coplanar grid structure functions in much the same manner as the control grid of a vacuum tube triode which functions to control the amount of electrons from the electronic storage tube electron beam 13 permitted to strike the surface areas 11*a* of the conducting silicon 11. The control grid of a vacuum tube triode controls the amount of electrons reaching the anode by controlling the voltage level applied to the control grid such that when the control grid is driven more negative, fewer electrons reach the anode, until a cut-off point is reached, and conversely, by driving the control grid more positive, an increasing number of electrons from the cathode are permitted to pass to the anode.

The analogous function is performed by the coplanar grid structure of the present invention by creating a surface potential upon the coplanar grid surface by bombarding the surface with electrons together with the application of predetermined control voltages.

The electron storage tube has three basic modes of operation, namely read, write and erase.

In the erase mode, a target voltage $V_{T_E}$ is applied at terminal 14 and may typically be of the order of +20 volts. The electron beam 13 is caused to sweep in the desired manner across the strips 12. The electrons from beam 13 create a charge pattern on the surfaces of the strips 12 which builds up until the surface potential is reduced to the same potential level as the electron gun cathode 15, which is typically maintained at ground potential. Thus, a uniform charge pattern, which creates a surface potential of 0 volts when the target voltage is maintained at +20 volts, is developed.

In order to assure that complete erasure has taken place, the target voltage is shifted down to a voltage typically employed as the read voltage level $V_{T_R}$ which is typically of the order of +10 volts. Since the strips 12 act as capacitances, their stored charge condition cannot change instantaneously so that the surface potential accordingly shifts down with the change in target voltage to a value of −10 volts. The electron beam 13 is then caused to scan the target and the target current $I_T$ is monitored. Since the surface potential of the strips 12 is −10 volts, which potential level is below the ground reference potential of the electron cathode 15, the coplanar grid structure repels electrons. For a typical structure in which the exposed silicon area equals the coplanar grid area, a coplanar grid surface potential equal and opposite (in polarity) to the target voltage is sufficient to prevent any electrons from striking the exposed surface 11*a* of the conducting silicon so that a zero target current is detected indicating that the erasure operation is complete.

In the write mode, the target voltage is shifted upward to a value $V_{T_W}$ which is typically of the order of +300 volts. The capacitive coupling to the surface of the coplanar grid strips 12 is such as to cause the surface potential to be shifted upwardly by an equivalent amount so that the surface potential at this time is of the order of +280 volts. The electron beam 13 is caused to scan the target and simultaneously therewith, a modulating voltage is applied at terminal $G_1$ of the electron gun control grid 16. The high surface potential of the coplanar grid causes a significant acceleration of the electrons in the electron beam 13, causing the electrons to strike the surfaces of strips 12 with a velocity sufficient to knock off electrons from the surfaces in significantly greater numbers than the electrons from the beam which are captured by the surfaces of the strips. This secondary emission effect causes the strips 12 to give up electrons at a rate much more rapidly than the surfaces accept electrons which results in the surface potential being driven to a more positive level. The degree of increase in surface potential is a function of the intensity of the beam which strikes at any particular location, with beam intensity being controlled by the modulated voltage applied to the electron gun control grid $G_1$. The surface potential typically lies in the range from +280 volts to +290 volts, and represents the image of the data or other subject matter to be displayed.

In the read mode, the target voltage is shifted downwardly to the read voltage level $V_{T_R}$ which is typically of the order of +10 volts as was referred to hereinabove. The electron beam 13 is caused to scan the target. The beam is unmodulated, the voltage applied to the control grid electrode $G_1$ being maintained as a constant value. Since the read voltage applied to the target is of the order of +10 volts, the surface potential of the coplanar grid structure will now be in the range from −10 to −5 volts and in certain applications in the range from −10 to 0 volts. When the beam sweeps locations where the surface potential of the coplanar grid structure is at a minimum value of −10 volts, the electrons in the beam will be repelled and thereby prevented from striking the bare surface area 11*a* of the conducting silicon 11 adjacent thereto so that no target current $I_T$ will be detected at those locations. As the beam 13 scans regions where the coplanar grid structure is more positive (i.e. closer to +0 volts) the repelling effect of the coplanar grid structure is diminished enabling more electrons to strike the areas 11*a* of the target adjacent to those positions where the surface potential of the coplanar grid is closer to ground or reference potential. Since the surface potential of the coplanar grid structure is preferably always less than the 0 volt level and since the electron gun cathode 15 is maintained at reference potential, electrons are repelled from striking the surface of the coplanar grid structure so that the charge pattern created thereon is unaltered even after repeated read operations are performed.

The stored image may be viewed by amplifying the target current $I_T$ and coupling it to a conventional cathode ray tube display device which is scanned in synchronism with the scanning of target 10 by electron beam 13 so as to create a visually observable picture of the stored image. If it is desired to replace the stored image with another image, another erasure operation is performed and takes place in the same manner as was described hereinabove.

While target structures of the conventional type designated by the numeral 10 in FIG. 1 have reasonably good retention times, it has nevertheless been found that the stored image will fade after repeated read operations. Careful observations have been made of storage tubes of the type shown in FIG. 1 in an effort to determine the cause of fading. One well known fact is the effect of positive gas ions present in the electronic storage tube envelope. Just as in the case of gas generated "grid-leak" currents in a vacuum tube triode, positive gas ions generated by collision of the electron beam with residual gas molecules are attracted to and land on the negatively charged coplanar grid surface. This is believed to cause the surface potential to slowly drift from a negative value upwardly toward zero voltage. In other words, an erased, or "black" region will slowly fade toward "white". The rate at which the gas ion current fades the image towards white depends also on the ionizing beam current as well as the capacitance of the coplanar grid structure. The higher the grid structure capacitance, the slower the image fade rate and the greater the image retention time.

In use, however, it is desirable to minimize erase time while maximizing retention time. Defining a quality factor "$K$" as $$K = \frac{\text{retention time}}{\text{erase time}} = \frac{\tau_r}{\tau_e}$$

then, although target capacitance (which may be varied by changing the thickness of the strips 12) represents a means of increasing or decreasing retention time and erase time, these values change proportionately while the quality factor does not.

The effect of residual gas in the tube upon retention time was carefully observed and it was found that the amount of residual gas was one or two orders of magnitude too low to be considered as the primary source for image face. However, during experimentation it was observed that the electron beam 13, upon striking the electronic storage tube grid deceleration mesh (not shown for purposes of simplicity) created ionizing radiation (i.e. X-radiation) which increased the conductivity of the silicon dioxide strips 12. It was this observation that led to the novel structure of the present invention.

Figure 2:
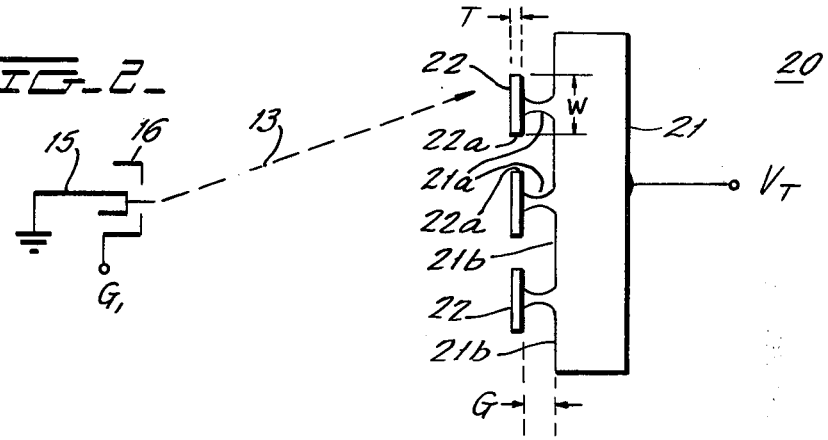
FIG. 2 shows one preferred embodiment of a target structure embodying the principals of the present invention.

One preferred embodiment of the present invention is shown in FIG. 2 wherein the target structure 20 is comprised of a conducting member 21 which may preferably be formed of silicon. Each of the strips are mounted upon pedestals 21*a* which form an integral part of the conducting silicon 21. Confronting edges 22*a* of adjacent strips 22 are separated by a spaced distance so as to expose bare surface areas 21*b* of the conducting silicon. The pedestals are extremely slender and preferably have a width in the range from 10 to 50 percent of the width W of the strips 22. The distance G between the confronting surfaces of the strips 22 and the bare surface areas 21*b* is typically in the range from 0.2$\mu$M to 2.0$\mu$M. The thickness T of strips 22 is relatively noncritical as the control capacitance is primarly determined by the vacuum gap G.

Although the pedestals 21*a* are formed of conducting silicon, they are sufficiently thin so that the area of contact with the strips is small and hence the effect upon the capacitance of the gaps G formed between the confronting surfaces of strip 22 and the bare area 21*b* is relatively minor. The capacitance value of the gaps is primarily a function of the dielectric constant of a vacuum (the electronic storage tube being comprised of an evacuated envelope) and the thickness G of the gap. The operational modes of the novel structure of FIG. 2 will now be described in connection with the curves shown in FIGS. 2*a*–2*c*.

In the erase mode, the target voltage $V_{T_E}$ is elevated to a level of +20 volts as shown in FIG. 2*a* where the region between dotted lines 25 and 26 represent the conducting silicon 11; dotted line 26 represents the interface between the vacuum gap and the conducting silicon; the regions between lines 26 and 27 represent the vacuum gap region; dotted line 27 represents the interface between the vacuum gap and the strip 12; the region between lines 27 and 28 represent the insulation strip 12; and wherein line 28 represents the surface of strip 12. It should be noted that the distances between lines 25–28 in FIGS. 2*a*–2*c* have been exaggerated for purposes of clarity. Curve C represents the potential distribution across the target wherein curve portion 28*a* represents the potential distribution across the conducting silicon 21, curve 28*b* represents the potential distribution across vacuum gap G and curve portion 28*c* represents the potential distribution across strip 12. It should be understood that the gap G is a vacuum gap since the electron storage tube is comprised of an evacuated envelope which is maintained in a substantially vacuum condition so that the dielectric constant in the region of the gap G is that for a vacuum.

With the target voltage $V_T$ maintained at the erase mode level but prior to initiation of the erasure operations, let it be assumed that no charge appears across gap G and across strip 12 as represented by dotted line 29. With the target voltage maintained at +20 volts, the electron beam 13 is caused to scan the target. Since the surface potential represented by dotted line 29 is positive, electrons will be collected on the surface to drive the surface potential increasingly more negative as represented by the dotted line curves 30, 31, 32, 33 and 34. Ultimately, a sufficient number of electrons will be stored by the coplanar grid surface 28 to drive the surface potential to point 35. Point 35 is located at the 0 volt or cathode reference potential. Since the electron gun cathode 15 is maintained at reference potential, no further electrons will be accepted by the surface of strip 12 so that the final potential distribution across the strip 12 and the vacuum gap G will be that shown by the curved portions 28*c* and 28*b* respectively, It can clearly be seen that the major part of the potential difference exists across vacuum gap G due to the fact that its capacitance is typically much less than the capacitance of strip 12.

In the write mode, and making reference to FIG. 2*b*, the target voltage is elevated to the write mode level $V_{T_W}$ which is typically of the order of +300 volts. Since the voltage distribution across gap G and strip 12 cannot change instantaneously the voltage level at interface 27 and at surface 28 will be shifted upwardly by an equal amount so that the voltage level at surface 28 will be of the order of +280 volts. FIG. 2*b* shows the curve portions 28*a*′, 28*b*′ and 28*c*′ as being substantially identical to the curve portions 28*a*, 28*b* and 28*c* of FIG. 2*a* with the exception that these curve portions have shifted upwardly due to the upward shift in target voltage.

As was described in detail hereinabove in connection with the embodiment of FIG. 1, the elevated surface potential at surface increases the velocity of electrons in beam 13 so that the electrons strike surface 28 with an impact sufficient to knock off a greater number of electrons that are accepted by the surface from beam 13, thereby driving the surface more positive, with the increase in positive potential level as shown, for example, by points 35′ and 35″ of FIG. 2*b*, being a function of the modulating voltage applied to the control grid electrode $G_1$ of the storage tube electron gun.

Upon completion of the writing operation, the surface 28 will have a stored change pattern which creates a surface potential representative of the image to be stored.

In order to display the image, the storage tube is placed in the read mode condition whereupon the target voltage $V_{T_R}$ is shifted downwardly to a value of the order of +10 volts. Since the charge and electric field distribution across gap G and strip 12 does not change, the voltage levels at surface 28 and interface 27 are shifted downward by an equal amount so that the voltage level along surface 28 will typically lie in the range from −10 to −5 volts. In order to read out and display the stored image, a constant voltage is applied to the control grid electrode $G_1$ and the electron beam is then caused to scan the target. When the electron beam comes into the region of a location on the surface 28 which is at −10 volts, the electrons in the beam will typically be completely repelled and prevented from striking the bare conducting silicon surface area 21*b* immediately adjacent this particularly value of surface potential so that no target current $I_T$ will be detected. As the electron beam scans an area where the surface potential is more positive (i.e. closer to 0 volts) the repelling effect of the surface potential is diminished, causing electrons in the beam to strike the bare conducting silicon surface area 21*b* adjacent this particular surface potential wherein the more positive the surface potential the more electrons are permitted to strike the conducting silicon area 21*b* adjacent thereto. The target current detected at this time will be greater than zero and is proportional to the value of the surface potential, in that the more positive the surface potential, the greater the magnitude of target current.

The stored image may be viewed by modulating the electron beam of a cathode ray tube display device with a voltage signal derived from the storage tube target current while the display device is scanned in synchronism with the scanning of target 20 by beam 13.

Although the stored charge pattern is not uniform (the pattern being a function of the stored image) the surface potential of the stored pattern is preferably maintained negative with respect to the cathode at all points on the grid structure. Since the electron beam cathode 15 is maintained at zero volts reference potential, the surface 28 will repel electrons from landing on the grid structure and thereby retain its stored charge pattern even after repeated read operations.

The significant improvement in retention time of the storage tube employing a target structure of the type shown in FIG. 2 can best be understood from a consideration of FIG. 2*c*. Assuming that the target voltage is maintained at the read level, which is typically of the order of +10 volts, curve portion 28*a*″, 28*b*″ and 28*c*″ represent the potential distribution across the target structure.

In target structures of the type shown in FIG. 1, the strips 12 can be seen to be in direct contact with the conducting silicon 11 so that the voltage distribution can be represented by dotted curve 37 of FIG. 2*c* wherein the regions 12 and G may be considered to be equivalent of the silicon dioxide layer. Assuming that the silicon dioxide layer is exposed to ionizing radiation as a result of the electron beam striking the grid deceleration mesh, the ionizing radiation significantly increases the conductivity of the silicon dioxide layer. Since the interface between the silicon dioxide and the conducting silicon, represented by dotted line 26, is more positive than surface 28 and since the mobility of the electrons through the silicon dioxide layer is enhanced, electrons on surface 28 are attracted toward the more positive level (+10 volts) at interface 26 causing surface 28 to go increasingly more positive as represented by dotted line curves 38 and 39 resulting in fading and ultimately in the loss of the stored image. Measurements on actual tubes have shown that retention times of the targets of the type shown in FIG. 1 of 5 to 15 minutes are typically observed.

Assuming that the target of the type shown in FIG. 2 is exposed to ionizing radiation of a similar level, so as to increase the conductivity of layer 12, it can be seen that although the voltage level at interface 27, represented by points 40, 40' and 40'' in FIG. 2*c* is more negative than the potential at interface 26, no conduction of charge occurs across the vacuum gap G. Hence, only the relatively small relaxation of the electric field in the insulator strip 12 will occur via a transport of charge between surface 28 and interface 27, resulting in curves 28*b'''*–28*c'''* and 28*b''''*–28*c''''*.

Even this small field relaxation in strip 12 can be minimized utilizing a material for layer 12 which is substantially insensitive to ionizing radiation. Suitable materials which may be employed for this purpose are silicon nitride, aluminum oxide and silicon oxy-nitride. The immunity of these materials to radiation has been found to provide a still further enhancement of image retention time. Measurements on actual tubes have shown that for a target structure employing silicon nitride as the layer 12, a retention time of the order of one hour was observed. It was further found that the erase level remained very stable for hours.

The separation or gap between the surface 28 of the grid structure and the surface 21*b* of the conducting silicon increases the writing speed due to the fact that capacitance is minimized. Hence, less electrons are required on the surface 28 to attain cut-off surface potential and block current from reaching the bare conducting surfaces 21*b*.

The target structure 20 of FIG. 2 may be formed by etching the conducting silicon in such a manner as to form the support pedestals from the conducting silicon but to otherwise isolate and minimize the capacitance of the layers 12 by making the pedestals sufficiently thin. An alternative and novel approach which avoids the necessity for etching the conducting silicon, consists of introducing a layer of material between the radiation resistant layer and the substrate 21, which intermediate layer can then be etched away to yield a small support pedestal. This method will now be described in connection with FIGS. 3*a*–3*c*.

Figure 3A:
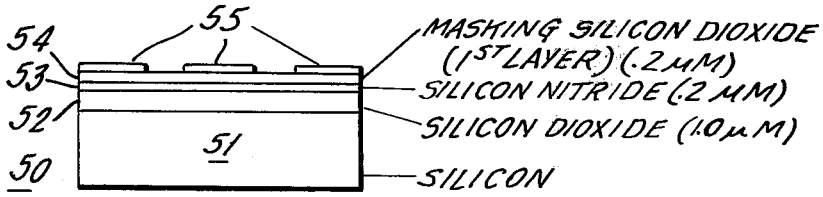
Figure 3B:
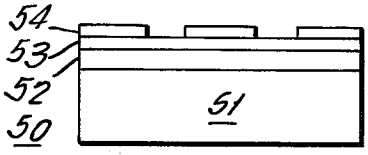
Figure 3C:
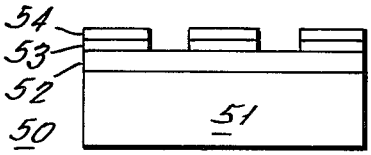

FIG. 3*a* shows a multi-layered assembly 50 comprised of a layer of conductive silicon 51, a layer 52 of silicon dioxide, a layer 53 of silicon nitride, and a layer 54 of silicon dioxide. The thicknesses of layers 52, 53 and 54 are typically 1.0 $\mu$m, 0.2 $\mu$m and 0.2 $\mu$m respectively, although other thicknesses which deviate from these values may be employed. A suitable photoresist material is applied in a striped pattern as shown at 55 for masking purposes. The assembly is etched by employing a buffered HF etchant which etches away the bare portions of silicon dioxide in layer 54 to form the strips as shown in FIG. 3*b*. The photo resist material 55 is then removed and the silicon nitride layer is then etched by employing a hot phosphoric acid. The silicon dioxide strips 54 which are not attacked chemically by phosphoric acid function as a mask so that the etchant (phosphoric acid) eats away only the bare areas of the silicon nitride layer to form the pattern as shown in FIG. 3*c*.

Figure 3D:
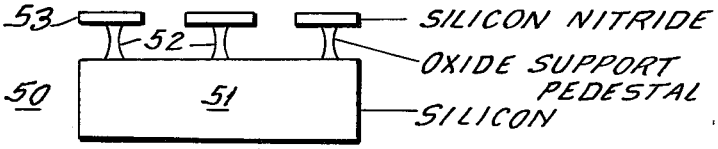

Using the known etch rate of silicon dioxide, the assembly is then etched in HF until the silicon dioxide layer 52 is "undercut" leaving the major portion of the silicon nitride layer 53 isolated. The etching operation is continued until the undercutting forms the pedestals 52 as shown in FIG. 3 *d*. It should be noted that this etching opertion simultaneously removes the masking oxide layer 54 so that the top surfaces of the silicon nitride are also bare as shown in FIG. 3*d*. Thus, the novel target assembly of FIG. 3*d* is formed which is comprised of the conducting silicon 51 having pedestal 52 of silicon dioxide which supports the silicon nitride strips 53 in the manner shown. The method described herein provides precise control over the thickness G of the gap region simply by controlling the thickness of layer 52.

Although the assembly of FIG. 3*d* shows the strips 53 as being formed of silicon nitride, it should be understood that any other material which is substantially immune to ionizing radiation may be employed. Other suitable materials are aluminum oxide and silicon oxy-nitride. Alternatively, the strips 53 of FIG. 3*d* may be formed of a material which is not immune to ionizing radiation such as, for example, silicon dioxide. In such instances, the pedestals may be formed of a radiation insensitive material for supporting strips which, in turn, are formed of a material which is sensitive to ionizing radiation. Also, although the strips and pedestals are each shown as being composed of a single material, they may each in fact be composed of layers or combinations of several materials.

Whereas the preferred grid structure arrangement is one in which the strips are elongated and arranged in spaced parallel fashion, it should be understood that other arrangements may be employed, such as, for example, small, rectangular or square-shaped "lands" each supported by a separate pedestal, and arranged in an M column by N row pattern.

FIGS. 4*a* and 4*b* show additional preferred embodiments of the present invention. FIG. 4*a* shows a perspective view of a target structure 60 comprised of a support member 61 having a conducting layer 62 on one surface thereof. It should be noted that the conducting layer 62 which may, for example, be silicon, may be either integral with support 61 (i.e. both support 61 and layer 62 being formed of silicon) or the support may be formed of a different material. For example, the silicon conducting layer 62 may take the form of a silicon film deposited upon a substrate 61 formed of sapphire. A plurality of spaced substantially parallel pedestals 63 are arranged upon conducting layer 62 in the manner shown. Only two such pedestals are shown in FIG. 4*a* for purposes of simplicity. Each of the slender pedestals 63 position and support stripes 64 which are also preferably arranged in a spaced substantially parallel fashion so as to expose a region 62*a* of the conductive layer between their adjacent edges. Stripes 64, 64 serve as the charge storage region of a coplanar grid structure. The pedestals may be formed of either a radiation sensitive material whose electrical conductivity increases in the presence of ionizing radiation or alternatively may be formed of a radiation insensitive material whose electrical conductivity remains substantially unchanged in the presence of ionizing radiation. Suitable materials selected may be taken from those described hereinabove. Likewise, the strips 64, 64 are formed of as insulation material which may be either radiation sensitive or radiation insensitive.

FIG. 4*b* shows another preferred embodiment of the present invention in which like elements as between FIGS. 4*a* and 4*b* are designated with like numerals. In the embodiment 60' of FIG. 4*b*, the pedestals 63' have a post-like shape each serving to support a charge storage element which may, for example, be of rectangular shape as is shown. It should be understood that, for